US007985165B1

(12) United States Patent
Lin et al.

(10) Patent No.: US 7,985,165 B1
(45) Date of Patent: Jul. 26, 2011

(54) ELLIPTICAL EXERCISE MACHINE

(75) Inventors: Dan Lin, Taichung County (TW); A-Liang Chien, Taichung County (TW)

(73) Assignee: Strength Master Fitness Tech. Co., Ltd., Taichung (TW)

( * ) Notice: Subject to any disclaimer, the term of this patent is extended or adjusted under 35 U.S.C. 154(b) by 0 days.

(21) Appl. No.: 12/778,444

(22) Filed: May 12, 2010

(51) Int. Cl.
*A63B 22/04* (2006.01)
*A64B 24/00* (2006.01)

(52) U.S. Cl. ..... 482/52; 482/62; 482/51

(58) Field of Classification Search ..... 482/51–53, 482/57, 62, 70, 79–80
See application file for complete search history.

(56) References Cited

U.S. PATENT DOCUMENTS

| | | | | |
|---|---|---|---|---|
| 5,242,343 | A * | 9/1993 | Miller | 482/57 |
| 5,924,962 | A * | 7/1999 | Rodgers, Jr. | 482/57 |
| 6,361,476 | B1 * | 3/2002 | Eschenbach | 482/52 |
| 6,440,042 | B2 * | 8/2002 | Eschenbach | 482/52 |
| 7,060,005 | B2 * | 6/2006 | Carlsen et al. | 482/52 |
| 7,267,638 | B2 * | 9/2007 | Wang | 482/52 |
| 7,438,671 | B2 * | 10/2008 | Wang | 482/52 |
| 7,611,446 | B2 * | 11/2009 | Chuang et al. | 482/52 |
| 7,618,351 | B2 * | 11/2009 | Kwon et al. | 482/52 |
| 7,670,267 | B2 * | 3/2010 | Wang | 482/52 |
| 7,682,289 | B2 * | 3/2010 | Chen | 482/51 |
| 7,740,564 | B2 * | 6/2010 | Shen | 482/52 |
| 7,794,361 | B2 * | 9/2010 | Wang | 482/51 |
| 2007/0238580 | A1 * | 10/2007 | Wang | 482/52 |
| 2009/0011904 | A1 * | 1/2009 | Chuang et al. | 482/52 |

* cited by examiner

*Primary Examiner* — Steve R Crow
(74) *Attorney, Agent, or Firm* — Rosenberg, Klein & Lee

(57) ABSTRACT

An elliptical exercise machine comprises a frame, two transmission rods, two stepping rods, wherein the frame is provided with a driving wheel and two sides of the driving wheel are respectively provided with a crank. One ends of the two transmission rods are connected to two cranks. The two stepping rods are connected to two transmission rods. Another end of each stepping rod is pivoted with a towing rod. Each towing rod is pivoted to the frame. Relatively elliptical orbits are formed through the two stepping rods driven by the two swing arms and the two transmission rods. When the two stepping rods reach a left acme and a right acme of each elliptical orbit, the two towing rods further tow the stepping rods corresponding to each other to generate a quick return effect so that elliptical orbit motion can be smoother.

4 Claims, 7 Drawing Sheets

ELLIPTICAL EXERCISE MACHINE

BACKGROUND OF THE INVENTION

1. Field of the Invention

The present invention relates to a gymnastic apparatus, and more particularly to an elliptical exercise machine satisfying human factors engineering.

2. Description of the Related Art

According to a design of a conventional elliptical exercise machine, as shown in FIG. 7, a vertical rod 92 is upwardly extended from a front end of a machine rack 91. Two swing arms 83 are respectively pivoted to two sides of the vertical rod 92. A driving wheel 94 is installed to a rear of the machine rack 91. Two sides of the driving wheel 94 are respectively provided with a crank 95. A stepping rod 96 is respectively disposed to two sides of the machine rack 91, and a pedal 97 is respectively fastened to the two stepping rods 96. Front ends of the two stepping rods 96 are pivotally connected to other ends of the two swing arms 93. Rear ends of the two stepping rods 96 are respectively connected to the two cranks 95. The front ends of the stepping rods 96 are towed by the swing arms 93 to perform a reciprocating motion along an arc orbit. The rear ends of the stepping rods 96 are towed by the cranks 95 to move along a circle orbit. Accordingly, the pedals 97 on the two stepping rods 96 can move along an elliptical exercise orbit.

However, the lengths of the cranks 95 need to be regulated to satisfy demands on step lengths and heights for users with different body heights if the conventional elliptical exercise machine must suit users with different body heights. The design of the conventional elliptical exercise machine is that pedals 97 are fastened on the stepping rods 96, and the two stepping rods 96 are directly connected to the swing arms 93 and the cranks 95. When the design of the step lengths and heights is increased, the angles of the pedals 97 are also increased during the exercise process. The comforts and joint forces of users are influenced and difficult to satisfy the human factors engineering.

Moreover, if the elliptical orbit motion performed by the conventional elliptical exercise machine reaches a left acme and a right acme of an elliptic orbit, the curvature variation will be the maximum. In another word, tangential velocity variation reaches the maximum. Consequently, when the two pedals 97 stepped by the user are operated to reach the left acme and the right acme of the elliptical orbit, the operation is not smooth to cause inertia.

SUMMARY OF THE INVENTION

In view of the shortcomings of the prior art, the inventor(s) of the present invention based on years of experience in the related industry to conduct extensive researches and experiments, and finally developed an elliptical exercise machine.

Therefore, it is a primary objective of the present invention to overcome the aforementioned shortcoming and deficiency of the prior art by providing an elliptical exercise machine that may not change the swing angle of pedals due to the different designs of step lengths and step heights of the elliptical exercise machine and that satisfies human factors engineering.

It is a second objective of the present invention to further provide an elliptical exercise machine. When an elliptical orbit motion performed by the elliptical exercise machine reaches a left acme and a right acme, an inertia, which is generated from the left and right acmes reached by the elliptical orbit motion of the elliptical exercise machine, can be effectively improved, and the operation of the elliptical exercise machine can be smoother.

To achieve the foregoing objectives, an elliptical exercise machine provided by the present invention comprises:

a frame, one end of the frame having a vertical rod, another end of the frame having a resistance mechanism, the resistance mechanism comprising a driving wheel and a resistance wheel for driving the driving wheel and providing a resistance, a crank respectively disposed to a right side and a left side of the driving wheel;

two swing arms pivotally connected to a right side and a left side of the vertical rod, another ends of the two swing arms respectively forming a connection portion capable of forwardly and backwardly swinging with respect to the vertical rod;

two transmission rods, one ends of the transmission rods respectively connected to the two cranks, another ends of the transmission rods respectively connected to the connection portions of the two swing arms;

two stepping rods, one ends of the stepping rods pivotally connected to the two transmission rods, another end of each stepping rod pivotally connected to a towing rod, the towing rod pivotally connected to the frame, wherein while stepping on the two stepping rods, the two transmission rods are driven to drive the two cranks for relative rotation, and relatively elliptical orbits are formed through the two stepping rods driven by the two swing arms and the two transmission rods, and when the two stepping rods perform an elliptical orbit motion, the two towing rods perform a reciprocated towing motion within a towing angle that is smaller than 180 degrees, and when the two stepping rod are operated to reach a left acme and a right acme of each elliptical orbit, the two towing rods further tow the stepping rods to generate a quick return effect so that the elliptical orbit motion can be smoother without the inertia.

The present invention further provides an elliptical exercise machine comprising:

a frame having a front end and a rear end, the front end of the frame having a vertical rod and a resistance mechanism, the resistance mechanism having a driving wheel and a resistance wheel for driving the driving wheel and providing a resistance, a left side and a right side of the driving wheel respectively having a crank;

two swing arms pivotally connected to a left side and a right side of the vertical rod, another ends of the two swing arms respectively formed with a connection portion capable of forwardly and backwardly swinging with respect to the vertical rod;

two stepping rods, one ends of the two stepping rods respectively pivoted to the connection portions of the two swinging arms, another ends of the two stepping rods respectively pivoted to a towing rod, each towing rod downwardly pivoted to the frame;

two transmission rods, one ends of the two transmission rods pivotally connected to the two cranks, another ends of the transmission rods pivotally connected to the two stepping rods, wherein while stepping on the two stepping rods, the two transmission rods are driven to drive the two cranks for relative rotation, and relatively elliptical orbits are formed through the two stepping rods driven by the two swing arms and the two transmission rods, and when the two stepping rods perform the elliptical orbit motion, the two towing rods perform a reciprocated towing motion within a towing angle that is smaller than 180 degrees, and when the two stepping rod are operated to reach a left acme and a right acme of each elliptical orbit, the two towing rods further tow the stepping rods to generate a quick return effect so that the elliptical orbit motion can be smoother without the inertia.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
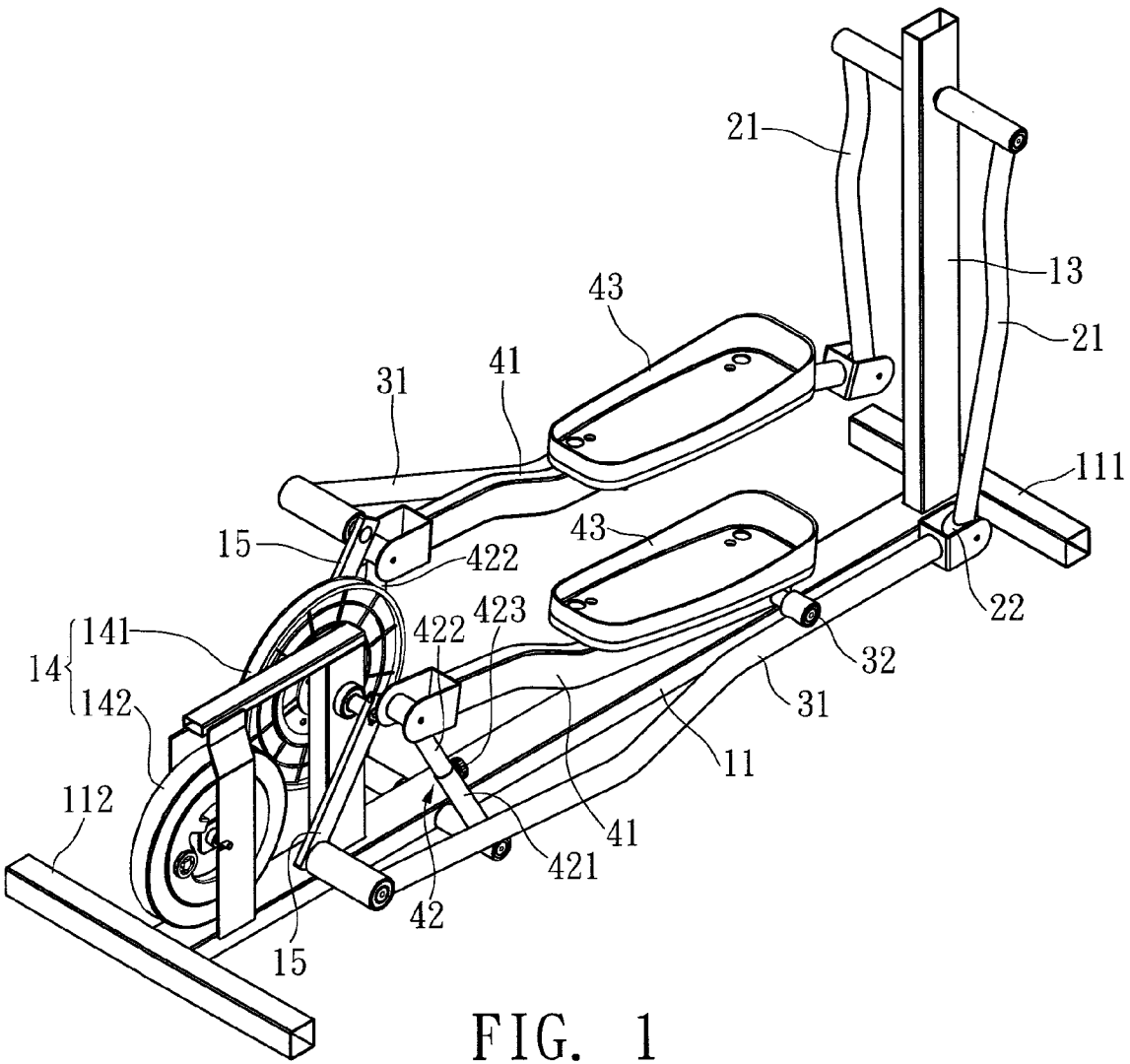
FIG. 1 is a schematic diagram of a solid structure according to a first embodiment of the present invention.
Figure 2:
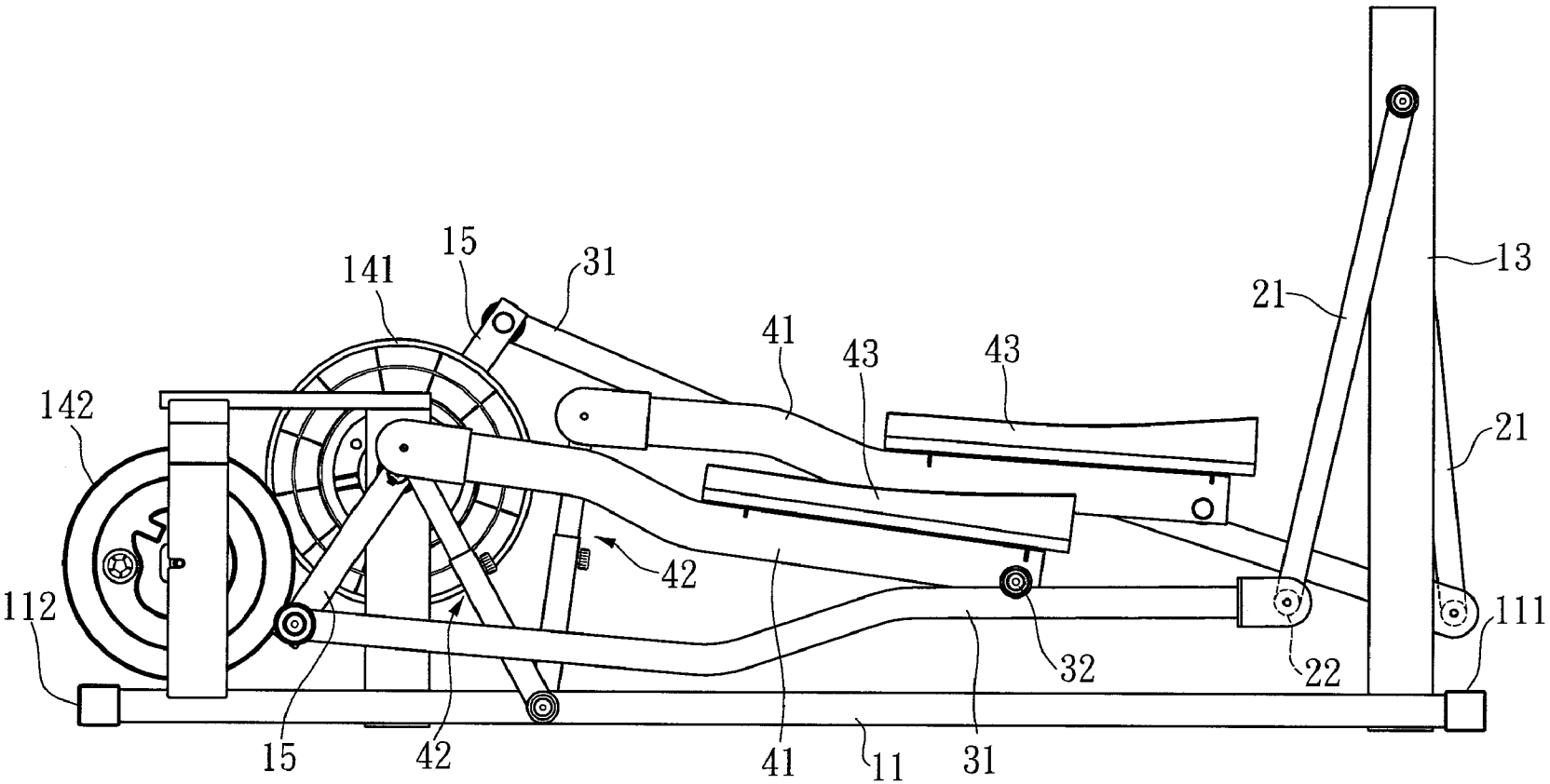
FIG. 2 is a schematic diagram of a planar structure according to a first embodiment of the present invention.

With reference to FIGS. 1 and 2 for an elliptical exercise machine in accordance with a first embodiment of the present invention, the machine is composed of a frame 11, two swing arms 21, two transmission rods 31 and two stepping rods 41.

The frame 11 can be stably placed on the ground. The frame 11 has a front end 111 and a rear end 112, and a vertical rod 13 extended vertically upward from the front end 111 of the frame 11. A resistance mechanism 14 is disposed to the rear end 112. The resistance mechanism 14 includes a driving wheel 141 and a resistance wheel 142 capable of driving the driving wheel 141 and providing a resistance. A left side and a right side of the driving wheel 141 are respectively provided with a crank 15 corresponding to one another.

One ends of the two swing arms 21 are respectively pivoted to a left side and a right side of the vertical rod 13. Another ends of the two swing arms 21 are downwardly extended and respectively formed with a connection portion 22 capable of forwardly and backwardly swinging with respect to the vertical rod 13.

One ends of the two transmission rods 31 are respectively pivoted to the two cranks 15. Another ends of the two transmission rods 31 are respectively pivoted to the connection portions 22 of the two swing arms 21, and the two transmission rods 31 are respectively formed with a pivot portion 32 relatively near rod bodies of the two swing arms 21.

One ends of the two stepping rods 41 are respectively pivoted to the pivot portions 32 of the transmission rods 31. Another end of each stepping rod 41 is pivotally connected to a towing rod 42. Each towing rod 42 is downwardly pivoted to the frame 11 relatively near the resistance mechanism 14. A pedal 43 is respectively fastened to a top of each stepping rod 41. In the embodiment, each towing rod 42 is composed of mutually fitting an outer tube 421 and an inner tube 422. Further, a positioning member 423 capable of positioning a position of the inner tube 422 relative to the outer tube 421 is respectively disposed to each outer tube 421. Accordingly, the swing angle of the stepping rods 41 can be changed by regulating the length of the towing rod 42.

Figure 3:
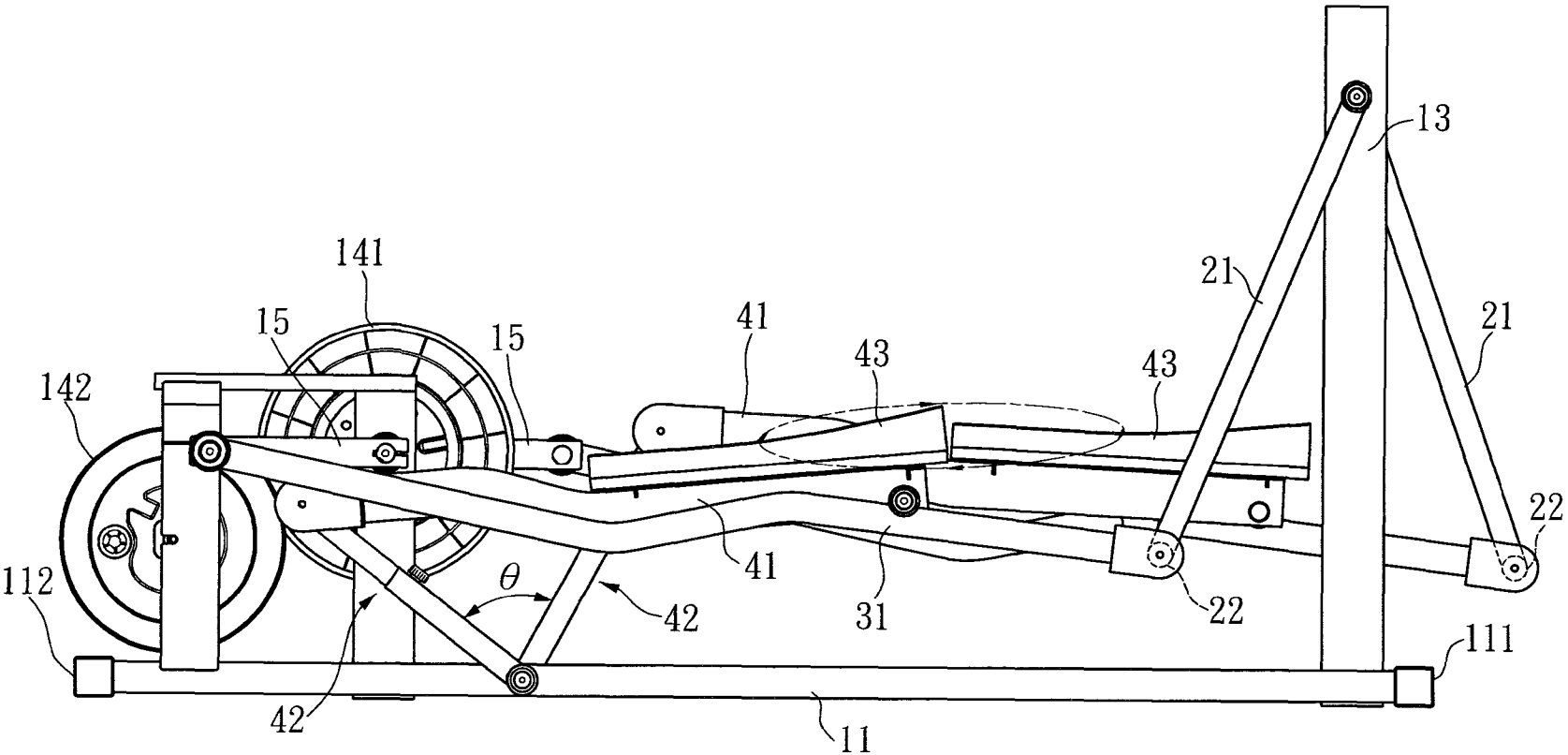
FIG. 3 is a schematic diagram of a usage status according to a first embodiment of the present invention, showing status of left and right acmes reached by an elliptical orbit motion.

When the machine of the present invention composed of the foregoing components is actually operated, as shown in FIG. 3, the two transmission rods 31 are driven to drive the two cranks 15 for relatively rotating by stepping the pedals 43 on the two stepping rods 41. Relatively elliptical orbits are formed through the two stepping rods 41 driven by the two swing arms 21 and the two transmission rods 31. Moreover, when the two stepping rods 41 perform the elliptical orbit motion, the two towing rods 42 perform a reciprocated towing motion within a towing angle θ that is smaller than 180 degrees. Accordingly, when the elliptical orbit motion is performed by a user's thenar, the pedals 43 on the stepping rods 41 can be towed by the towing rods 42 and moved upwardly or downwardly, so as to simulate the actual walking motion as good as humans.

The length of the two cranks 15 can be changed to alter both step height and length during the operation of the elliptical orbit motion. The pedals 43 are disposed on the stepping rods 41, and the stepping rods 41 are pivotally connected to the towing rods 42. While changing the lengths of the two cranks 15, the swing angle of the two transmission rods 31 can be changed as well. However, the stepping rods 41 are pivotally connected to the two transmission rods 31. Although the swing angles of the transmission rods 31 are changed, angles of the stepping rods 41 are not influenced. Accordingly, the two stepping rods 41 can be restricted to perform a reciprocating swing motion at the same predetermined angle. The swing angles of the two pedals 43 won't be changed due to the different designs of the step heights and lengths, thereby satisfying human factors engineering.

When the machine of the present invention performs the elliptical orbit motion and the stepping rods 41 driven by the transmission rods 31 are operated to reach a left acme and a right acme of an elliptical orbit, the two towing rods 42 further tow the stepping rods 41 corresponding to each other to generate a quick return effect so that when the two pedals 43 stepped by the user operate to reach the left and right acmes of the elliptical orbit, an inertia may not happen through the quick return effect generated by the two towing rods 42. The uncomfortableness caused by the inertia during the operation of the elliptical exercise machine can be improved to smooth the operation of the elliptical exercise machine.

Figure 4:
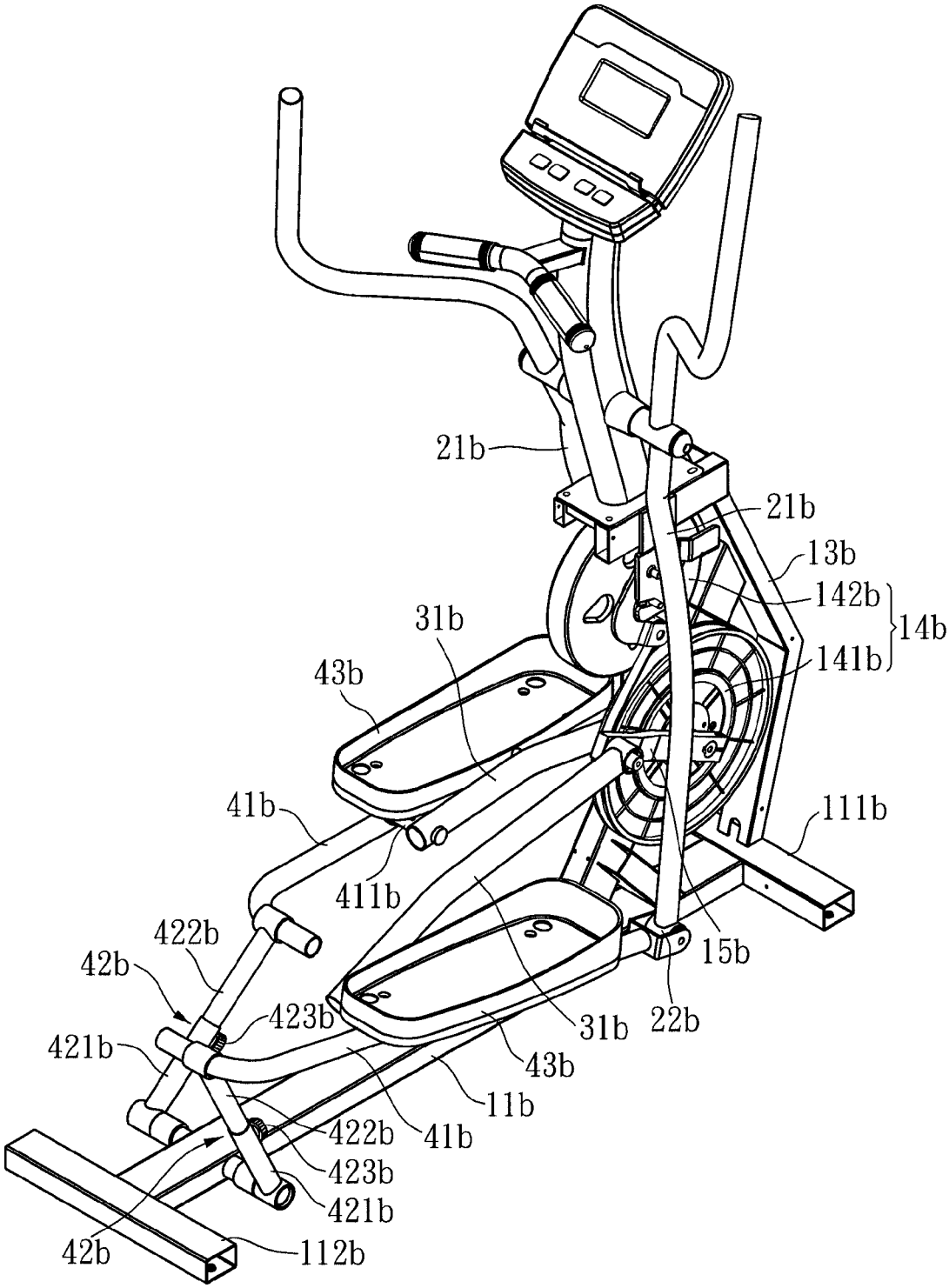
FIG. 4 is a schematic diagram of a solid structure according to a second embodiment of the present invention.
Figure 5:
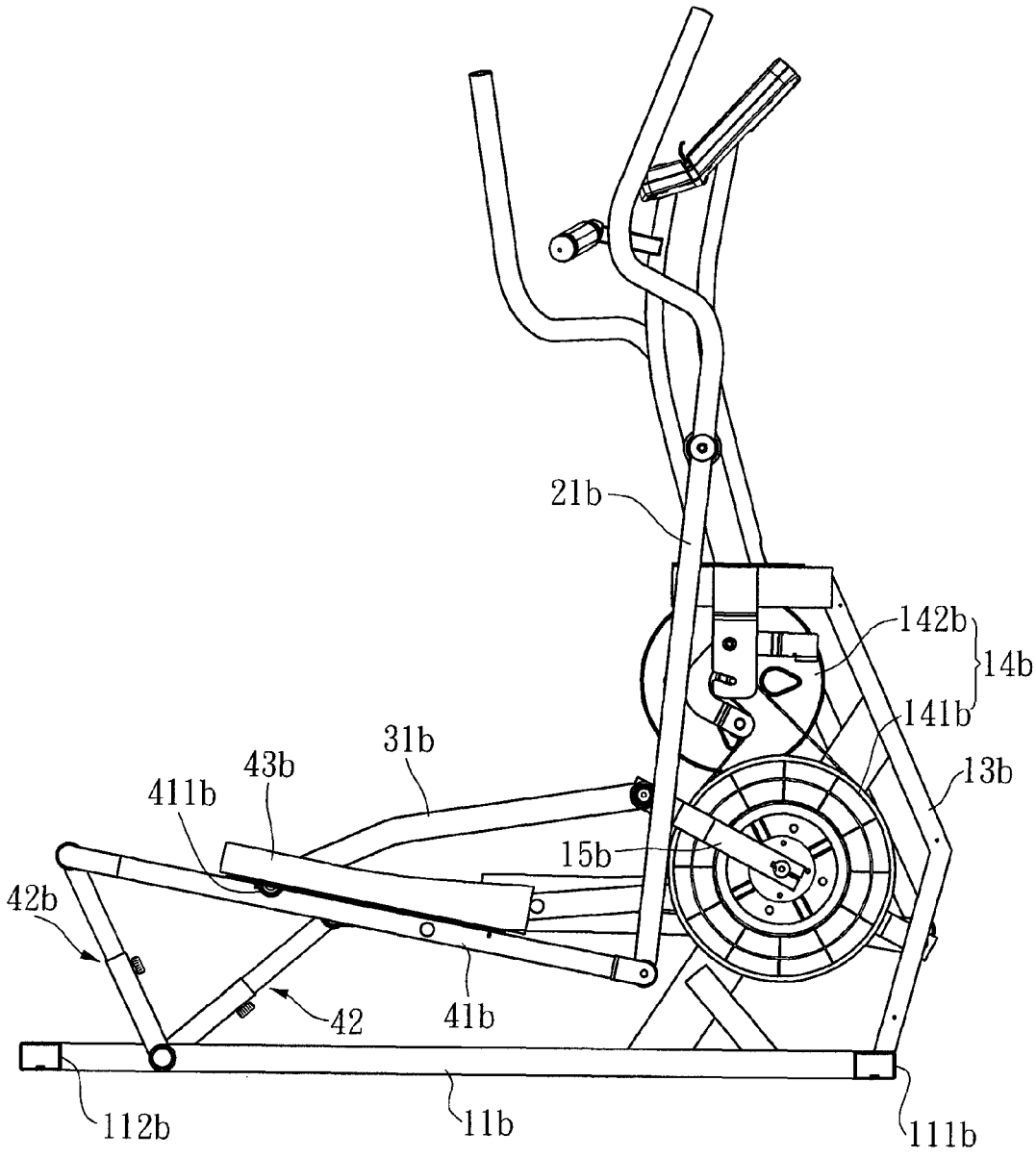
FIG. 5 is a schematic diagram of a planar structure according to a second embodiment of the present invention.

With reference to FIG. 4 to FIG. 5 for an elliptical exercise machine in accordance with a second embodiment of the present invention, the machine is composed of a frame 11*b*, two swing arms 21*b*, two transmission rods 31*b* and two stepping rods 41*b*.

The frame 11*b* has a front end 111*b* and a rear end 112*b*, and the front end 111*b* of the frame 11*b* is provided with a vertical rod 13*b*, which is upwardly extended, and a resistance mechanism 14*b*. The resistance mechanism 14*b* includes a driving wheel 141*b* and a resistance wheel 142*b* capable of driving the driving wheel 141*b* and providing a resistance. A left side and a right side of the driving wheel 141*b* are respectively provided with a crank 15*b* corresponding to one another.

One ends of the two swing arms 21*b* are respectively pivoted to a left side and a right side of the vertical rod 13*b*. Another ends of the two swing arms 21*b* are downwardly extended and are respectively formed with a connection portion 22*b* capable of forwardly and backwardly swinging with respect to the vertical rod 13*b*.

One ends of the two stepping rods 41*b* are respectively pivoted to the connection portions 22*b* of the two swing arms 21*b*. Another ends of the two stepping rods 41*b* are respectively pivoted to a towing rod 42*b*. Each towing rod 42*b* is downwardly pivoted to the frame 11*b* that is distant from the resistance mechanism 14*b*. In the embodiment, each towing rod 42*b* is composed of mutually fitting an outer tube 421*b* and an inner tube 422*b*. The outer tube 421*b* is provided with a positioning member 423*b* capable of positioning a position of the inner tube 422*b* relative to the outer tube 421*b*. The swing angles of the stepping rods 41*b* can be changed by regulating lengths of the towing rods 42*b*. A pivot portion 411*b* is respectively formed to rod bodies of the two stepping rods 41*b*. A pedal 43*b* is respectively fastened to tops of the two stepping rods 41*b* near the towing rods 42*b*.

One ends of the two transmission rods 31*b* are respectively pivoted to the two cranks 15*b*. Another ends of the two transmission rods 31*b* are respectively pivoted to the pivot portions 411*b* of the two stepping rods 41*b*.

Figure 6:
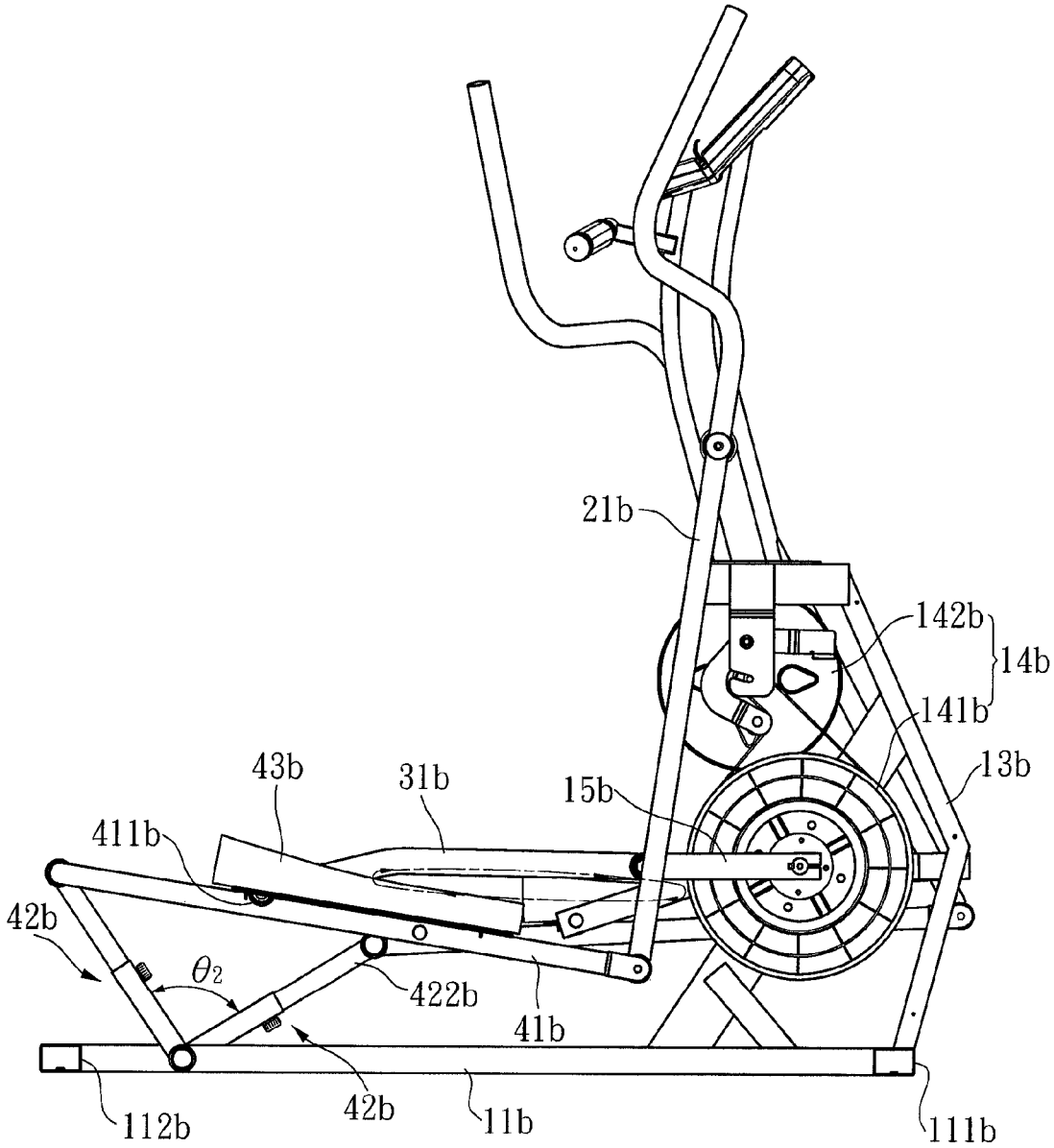
FIG. 6 is a schematic diagram of a usage status according to a second embodiment of the present invention, showing status of a left and right acmes reached by an elliptical orbit motion.
Figure 7:
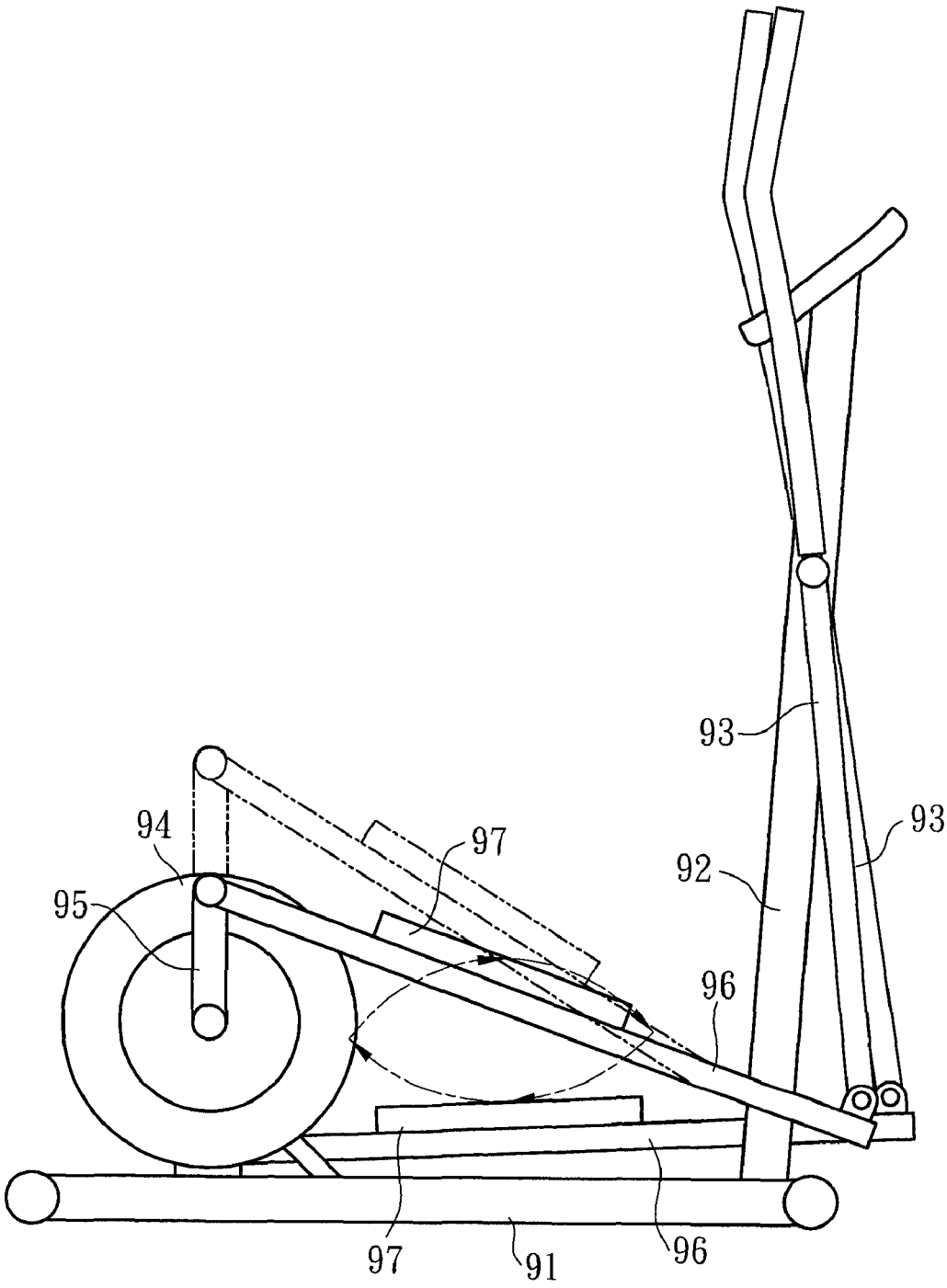
FIG. 7 PRIOR ART
FIG. 7 is a structural diagram of a conventional elliptical exercise machine.

When the machine of the present invention composed of the foregoing components is actually operated in accordance with a second embodiment, as shown in FIG. 6, the two transmission rods 31*b* are driven to drive the two cranks 15*b* for relatively rotating by stepping the pedals 43*b* on the two stepping rods 41*b*. Relatively elliptical orbits are formed through the two stepping rods 41*b* driven by the two swing arms 21*b* and the two transmission rods 31*b*. Moreover, when the two stepping rods 41*b* perform the elliptical orbit motion, the two towing rods 42*b* perform a reciprocated towing motion within a towing angle $\theta_2$ that is smaller than 180 degrees. Accordingly, the lengths of the two cranks 15*b* are changed to alter step lengths and heights of the elliptical orbit motion performed by the user. Since the pedals 43*b* are disposed on the stepping rods 41*b*, the stepping rods 41*b* are pivotally connected to the towing rods 42*b*. While changing the lengths of the two cranks 15*b*, the swing angles of the two transmission rods 31*b*. However, the two transmission rods 31*b* are pivotally connected to the stepping rods 31*b*. Although the swing angles of the transmission rods 31*b* are changed, the angles of the stepping rods 41*b* are influenced as well. Accordingly, the two stepping rods 41*b* can be restricted to perform a reciprocating swing motion at the same predetermined angle. The swing angles of the two pedals 43*b* won't be changed due to the different designs of the step heights and lengths.

When the machine in accordance with the second embodiment of the present invention performs the elliptical orbit motion and the stepping rods 41*b* driven by the transmission rods 31*b* are operated to reach a left acme and a right acme of the elliptical orbit, the two towing rods 42*b* further tow the stepping rods 41*b* corresponding to each other to generate a quick return effect so that when the machine in accordance with the second embodiment of the present invention performs the elliptical orbit motion, an inertia can be effectively prevented to smooth the operation of the elliptical exercise machine.

The present invention improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. An elliptical exercise machine comprising:

a frame having a front end and a rear end, the front end of the frame having a vertical rod extending therefrom;

a resistance mechanism disposed adjacent the front end of the frame and including a driving wheel and a resistance wheel driven by the driving wheel and providing a resistance thereto, the driving wheel having a crank respectively disposed on each of opposing sides thereof;

two swing arms each having one end respectively pivotally connected to a corresponding side of the vertical rod, the two swing arms each having another end formed with a respective connection portion for swinging forwardly and backwardly with respect to the vertical rod;

a pair of towing rods, each of the towing rods having one end thereof extending downwardly to be pivotally coupled to the frame;

two stepping rods, each of the two stepping rods having one end pivotally coupled to the connection portion of a corresponding one of the two swinging arms, each of the two stepping rods have another end respectively pivotally coupled to a corresponding one of the towing rods;

two transmission rods, each of the two transmission rods having one end respectively pivotally connected to a corresponding one of the two cranks, each of the transmission rods having another end respectively pivotally connected to a corresponding one of the two stepping rods, wherein while stepping on the two stepping rods, the two transmission rods are driven to drive the two cranks to rotate the driving wheel, the two stepping rods having relatively elliptical orbits formed through respective coupling to the two stepping rods driven by the two swing arms and the two transmission rods, responsive to the elliptical orbit of each of the stepping rods, the two towing rods perform a reciprocated towing motion within a towing angle that is smaller than 180 degrees, and when each of the two stepping rods are operated to a respective acme of the elliptical orbit thereof, the corresponding towing rod further tows the stepping rod to generate a quick return effect.

2. The elliptical exercise machine as recited in claim 1, wherein each of the two stepping rods are respectively formed with a pivot portion, and the two transmission rods are respectively pivoted to the pivot portions of the two stepping rods.

3. The elliptical exercise machine as recited in claim 1, wherein each of the towing rods respectively are pivoted to the frame at a location spaced from the resistance mechanism.

4. The elliptical exercise machine as recited in claim 1, wherein each towing rod includes an outer tube and an inner tube telescopically fitted together, the outer tube being provided with a positioning member for selectably positioning a location of the inner tube relative to the outer tube.

* * * * *